United States Patent [19]

Healy

[11] 4,056,131

[45] Nov. 1, 1977

[54] VAPOR CONTROL IN A FUEL DISPENSING NOZZLE

[76] Inventor: James W. Healy, 54 Plymouth Road, Wakefield, Mass. 01880

[21] Appl. No.: 656,124

[22] Filed: Feb. 9, 1976

Related U.S. Application Data

[63] Continuation-in-part of Ser. No. 553,529, Feb. 27, 1975.

[51] Int. Cl.[2] ..... B65B 3/04

[52] U.S. Cl. ..... 141/206; 141/392; 141/DIG. 1

[58] Field of Search ..... 141/59, DIG. 1, 97, 141/52, 392, 287, 41, 42, 307, 310, 290, 390, 383–386, 206–229, 301, 302

[56] References Cited

U.S. PATENT DOCUMENTS 3,899,009 8/1975 Taylor ..... 141/97

*Primary Examiner*—Houston S. Bell, Jr.
*Attorney, Agent, or Firm*—W. R. Hulbert

[57] ABSTRACT

Disclosed are various improvements in the vapor handling arrangements of a conventional fuel dispensing nozzle. In particular, there is shown a vapor shut-off valve that can override a vapor pressure regulator valve to seal the vapor conduit when fuel is not being dispensed; a magnetic sealing arrangement for preventing escape of vapor at the mouth of the vehicle fuel tank; and a relief valving arrangement to protect both the nozzle and the vehicle tank against excessive pressure conditions.

36 Claims, 2 Drawing Figures

VAPOR CONTROL IN A FUEL DISPENSING NOZZLE

CROSS REFERENCE TO RELATED APPLICATION

This is a continuation-in-part of my copending U.S. Patent Application Ser. No. 553,529, filed Feb. 27, 1975, for Vapor Control.

BACKGROUND OF THE INVENTION

This invention relates to the improvements in the vapor handling capacities of fuel dispensing nozzles.

A number of systems have been proposed for dealing with the hydrocarbon vapors displaced from the vehicle's fuel tank during a refueling operation. One such system is disclosed and claimed in the above-mentioned U.S. Patent Application Ser. No. 553,529. Each such system requires that the fuel dispensing nozzle be equipped to capture the displaced vapors and to convey them to a vapor conduit interconnecting the nozzle and any vapor handling system.

My previous patent application U.S. Ser. No. 553,529 teaches various valving arrangements for achieving better control of flow through the vapor recovery conduits. It is a principle object of the present invention to provide yet further improved valving arrangements for control of such flow. It is an additional object to provide an improved arrangement for sealing the vehicle fuel tank mouth during refueling in order to prevent the escape of hydrocarbon vapors to the atmosphere, as well as to prevent the introduction of air into the vapor recovery conduits. It is a further object of the present invention to provide the improved arrangements just mentioned in a form which can be easily incorporated into existing fuel dispensing nozzles.

SUMMARY OF THE INVENTION

Briefly, the invention features improvements in a fuel dispensing nozzle comprising a body having a fuel conduit leading to a spout insertable into a fuel tank and having a manually operable fuel valve, a vapor conduit for transporting vapor displaced from the tank to a remote vapor handling system, and a vapor shut-off valve in said vapor conduit. In the improved nozzle, the vapor shut-off valve comprises a diaphragm having surfaces facing the vapor conduit and a chamber within the nozzle, respectively. The diaphragm causes the vapor conduit to be blocked in a first position and not to be blocked in a second position. Biasing means urge the diaphragm toward its position that blocks the conduit. The nozzle further includes valve opening means for urging the diaphragm toward its second position only when fuel is flowing past the nozzle's fuel valve.

Preferably, a vapor regulator valve is also provided in the nozzle for regulating vapor flow through the vapor conduit in response to predetermined vapor conditions within the fuel tank and the conduits. The vapor pressure regulator valve may comprise a second diaphragm supported intermediate the first diaphragm and the vapor conduit with a resilient spacer disc between the two diaphragms for transmitting force therebetween. A spring biases the second diaphragm away from the vapor conduit (i.e., toward a "valve open" configuration). Excessive vacuum conditions on the conduit side of the second diaphragm will draw that diaphragm toward the conduit thereby sealing the conduit (i.e., "valve closed" configuration) overcoming the force of the biasing spring. The operation of the regulator valve is overridden by the shut-off valve which, under the influence of its biasing spring presses through the resilient spacer disc and forces the second diaphragm into a valve closed orientation whenever there is no fuel being dispensed from the nozzle.

In another aspect, the invention features improvements in a shroud member which surrounds a portion of the nozzle spout and which defines a portion of the vapor recovery conduit system. One improved feature of such a shroud is the provision of a magnetic disc as a portion of the shroud end plate, thereby assuring intimate contact of the end plate with the magnetically susceptible material which forms the mouth of the fuel tank. The shroud may further include a substantially inextensible, force-transmitting element extending between the end plate and the body of the fuel dispensing nozzle, whereby the magnetic attraction between the end plate and the fuel tank mouth may help support the weight of the nozzle to prevent accidental displacement of the nozzle from the fuel tank. Another desirable feature of such a shroud is the provision of one or more pressur relief valves integrally formed with the material of the shroud in order to relieve pressure differentials between the interior and exterior of the shroud.

As to each of the features of the invention summarized above, of course, the improved structural relationships according to the present invention can be provided in the form of replacement parts for existing fuel dispensing nozzles, as well as being incorporated into newly manufactured nozzles.

BRIEF DESCRIPTION OF THE DRAWINGS

Other objects, features, and advantages of the invention will appear from the following description of a particular preferred embodiment, which is illustrated in the accompanying drawings. In the drawings.

DETAILED DESCRIPTION OF A PARTICULAR PREFERRED EMBODIMENT

Figure 1:
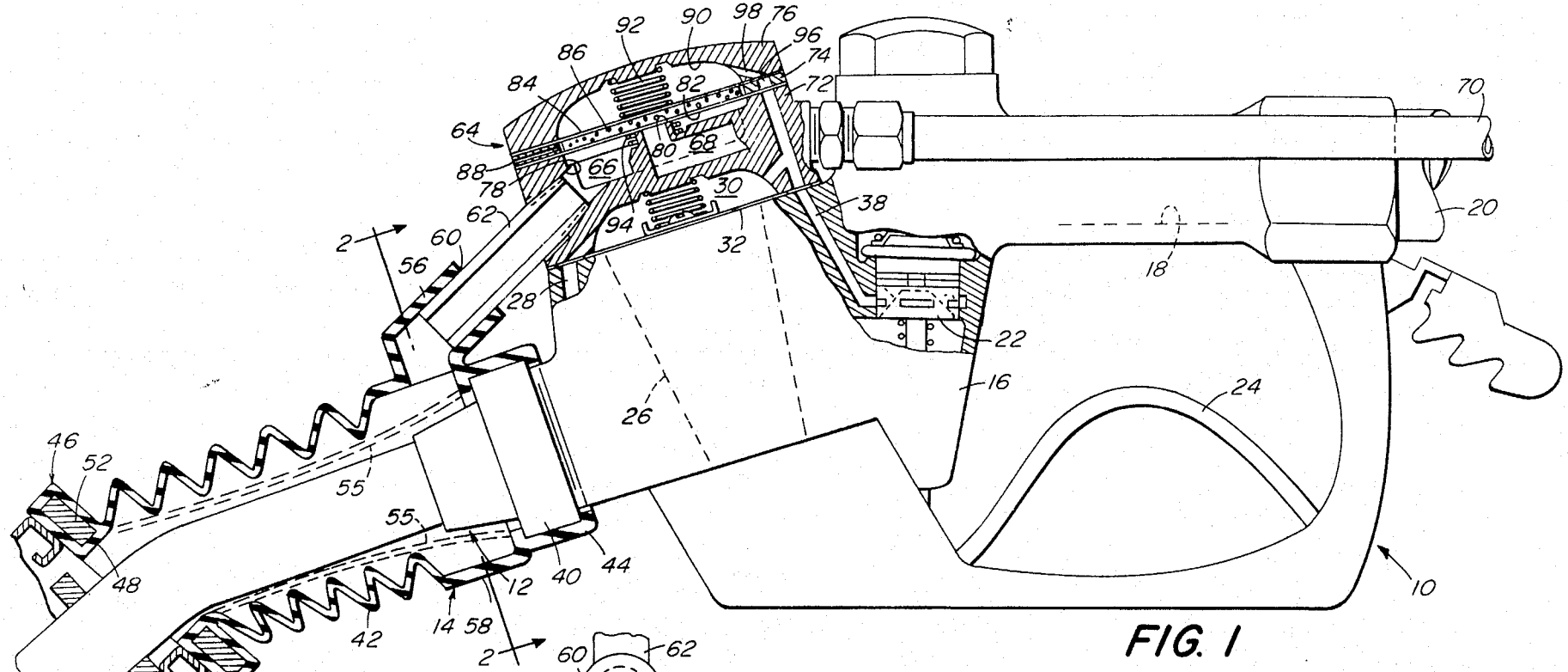
FIG. 1 is a partially sectioned side elevation of a fuel dispensing nozzle incorporating features of the present invention.

Referring to the drawings, the dispensing nozzle includes a body 10, a spout assembly 12, and a spout shroud 14. Body 10 comprises casting 16 having a fuel conduit 18 extending from a supply hose 20 to the spout. A biased-closed fuel valve 22 is operated by conventional manual fuel valve operator 24. A shut-off mechanism 26, which can be of the type disclosed in U.S. Ser. No. 553,529, is also provided and includes passageway 28 connecting chamber 30 above diaphragm 32 with the outlet end 34 of spout 36, and a second passageway 38 leading to the gasoline conduit 18 just below valve 22.

The spout assembly 12 includes spout 36, and a fitting 40 which secures the spout to the body casting 16. The shroud 14 includes a flexible bellows 42 surrounding the upper portion of the spout, an attachment portion 44 secured to the fitting 40, and an end plate 46 which includes an opening 48 communicating with the space between the bellows and the spout. End plate 46, which seals against the mouth of fuel tank fill pipe 50 when the spout is inserted into the fill pipe, also includes a disc magnet 52 (preferably, a ceramic-rare earth magnet having eight poles per face). The nozzle can be held in place in the fill pipe by a ring 54 which catches under the lip of the fill pipe mouth. (Alternatively, a conventional spring wrapped around the lower spout segment could be used.)

A series of relatively inextensible filaments 55 can be provided extending between the end plate and the attachment portion. When under tension, the filaments would serve to support part of the nozzle's weight by the magnetic attraction to the fill pipe. Naturally, a variety of other structures could perform the same function.

The shroud 14 also includes a resilient receptacle 56 which is integral with a shroud portion 58 adjacent the attachment portion 44 and which has an opening 60 for receiving a tube 62 in a leak-proof friction fit. In the preferred embodiment illustrated, the shroud 14 is molded as an integral unit from a resilient flexible material that is substantially unaffected by hydrocarbon liquid or vapors. One suitable material is urethane rubber. The shroud portions 44 and 58, as well as the receptacle 56 and the end plate 46, preferably have a greater wall thickness than the bellows portion 42. The thicker portions, of course, have functions which require somewhat greater rigidity, and somewhat less flexibility, than the bellows. It is also preferred that the magnet 52 be completely encased in the material of which the shroud is formed in order to protect the magnet from damage and to eliminate the possibility of sparks which could develop if the magnet were to directly strike the fuel tank fill pipe 50. As will be evident to those skilled in the art, a shroud formed in this fashion is easily installed on existing conventional fuel dispensing nozzles.

The space between the shroud 14 and the spout 36 forms a conduit for receiving vapors displaced from the fuel tank. Such vapors enter that space through the opening 48 and exit through a tube 62 which extends from the receptacle 56 through an opening in a cap assembly 64 of the nozzle to convey the vapors to a chamber 66 in the cap assembly. The chamber 66, in turn, communicates with a passageway 68, also provided in the cap assembly. The passageway 68 leads to an external conduit 70 that is connected to a remote vapor handling system (e.g., the jet pump-powered suction system described in the above-mentioned U.S. Application Ser. No. 553,529). Preferably, the tube 62, passageway 68, and conduit 70 have the same inner diameter (e.g., 5/16 inch) in order to provide a relatively uniform vapor flow conduit.

The cap assembly 64 comprises a stacked arrangement of parts which can be secured to the conventional nozzle body 16 by a series of screws (not shown) passing through all parts of the stack. The main structural elements of the cap assembly 64 are a body 72, spacer 74, and cap 76. The body 72 includes an opening 78 which receives the tube 62 and which communicates with the chamber 66 provided in the body 72. The passageway 68 in the body 72 terminates in an upwardly facing annular surface 80 which, as described below, forms a valve seat. The lower portion of body 72 is relieved to define the chamber 30 that cooperates with diaphragm 32 to provide the full-tank shut-off feature described in detail in the above-mentioned U.S. Patent Application Ser. No. 553,529.

A vapor pressure regulator diaphragm 82 and a vapor shut-off diaphragm 84 are clamped around their peripheries between, respectively, the body 72 and spacer 74 and the spacer 74 and cap 76. In the rest configuration illustrated, the diaphragms 82, 84 are substantially parallel and are separated by a spacer disc 86, preferably formed from a closed cell foam rubber and having a thickness substantially equal to the thickness of spacer 74. A small opening 88 in the spacer 74 maintains the volume between the diaphragms 82 and 84 and atmospheric pressure. The cap 76 defines a chamber 90 above the shut-off diaphragm 84. A shut-off diaphragm biasing spring 92 is disposed in that chamber and biases the diaphragm 84 toward the diaphragm 82 and the valve seat 80. The regulator diaphragm 82 is biased upwardly by a spring 94 disposed around the valve seat 80 in the chamber 66. The biasing forces of springs 92 and 94 are chosen such that the force of spring 92 can overcome the force of spring 94. Aligned openings 96 and 98 in the spacer 74 and the cap 76 connect the chamber 90 with the conduit 38.

Figure 2:
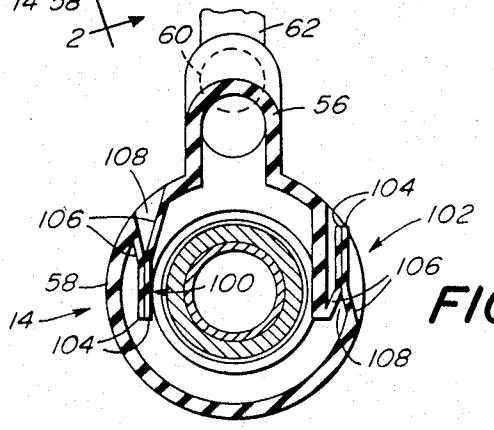
FIG. 2 is a view taken at 2—2 of FIG. 1.

Referring to FIG. 2, the shroud portion 58 is provided with a pair of integral pressure relief valves 100, 102. Each valve comprises a pair of adjacent flexible flaps 104, each integral with a biasing panel 106 that is, in turn, integral with the wall 58 at an opening 108 therein. As will be evident to those skilled in the art, valve 100 will permit air to enter the shroud to relieve an excessive vacuum and value 102 will permit vapor to escape from the shroud to relieve excessive pressure. With tight seal of end plate 46 to the fill pipe 50, the valves serve as an additional protection against pressure extremes which could damage the vehicle fuel tank.

The dual function valving arrangement provided in the cap assembly 64 can best be described by considering the operation of the regulator diaphragm 82 absent the shut-off diaphragm 84, and then considering the constraints imposed by the presence of the shut-off diaphragm 84. The vapor pressure regulator diaphragm is biased away from the valve seat 80 (i.e., in a "valve open" configuration) by the spring 94. In this "normal" orientation of the diaphragm 82, hydrocarbon vapor is free to pass through the chamber 66, passageway 68, and conduit 70 to the remote vapor handling system (not shown). Excessive vacuum levels beneath the diaphragm 82, however, can overcome the biasing force of spring 94 and cause the regulator valve to close (i.e., the diaphragm 82 to engage the valve seat 80).

It is very desirable, however, that the vapor recovery passages be sealed at all times when fuel is not being dispensed by the nozzle. This is accomplished, according to the present invention, by the vapor shut-off diaphragm 84. As is illustrated in FIG. 1, absent the flow of fuel through the nozzle, the spring 92 overcomes the force of spring 94 and its force is transmitted through diaphragm 84 and spacer disc 86 to force the diaphragm 82 against the valve seat 80. Thus, even if a suction is applied to the remote end of vapor conduit 70 (e.g., a system such as described in the above-mentioned U.S. Patent Application Ser. No. 553,529 in which a suction is generated when the fuel pump is turned on, even if the fuel is not yet being dispensed through the nozzle) air is prevented from being sucked into the vapor return system. When fuel is being dispensed, however, a slight vacuum is created in the chamber 90 above the shut-off diaphragm 84 by the venturi effect as fuel flows past the mouth of conduit 38. The suction is transmitted through conduits 38, 96, and 98 to the chamber 90. Spring 92 is chosen to have the force such that the vacuum level produced in chamber 90 (e.g., about 2 to 3 inches of water), when acting upon the exposed surface of diaphragm 84, is sufficient to overcome the force of spring 92, thereby causing a compression of spring 92 and a movement of the diaphragm 84 away from the diaphragm 82. When this occurs, of course, the regulator diaphragm 82 is free to act independently of the shut-off diaphragm 84 and to perform its regulatory function. An interruption in the flow of fuel causes the return of diaphragm 84 and spring 92 to the configuration shown in FIG. 1, so that the operation of diaphragm 82 is overridden by the shut-off diaphragm 84.

As will be evident to those skilled in the art, the vapor shut-off valving arrangement shown in FIG. 1 can be provided in a system where no vapor pressure regulator valve is required. In the so-called "vapor balance" systems for example, there is no suction applied to the vapor return conduit 70 and no possiblity of damage to the vehicle's fuel tank by excessive vacuum levels. The regulator valve is thus superfluous. It would still be desirable, however, to positively seal the vapor return conduit system when the nozzle is not in use in order to prevent air from entering that system. The vapor shut-off valve arrangement shown in FIG. 1 would provide a simple and effective way of achieving this, with the diaphragm 84 engaging the valve seat 80 directly.

The cap assembly 64 which provides the vapor conduit valving arrangements according to the present invention, can be provided as a replacement assembly for the conventional caps which enclose the full tank shut-off mechanism in existing fuel dispensing nozzles. Naturally, there may be modification of the cap assembly parts as illustrated in FIG. 1 in order to accommodate slightly different structural features of existing nozzles and/or different vapor handling systems (e.g., with a "vapor balance" system the diaphragm 82, spring 94, spacer 74, and spacer disc 86 could be eliminate). Similarly, the shroud 14 can be provided as an "add-on" feature for existing nozzles.

While particular preferred embodiments of the present invention have been illustrated in the accompanying drawings and described in detail herein, other embodiments are within the scope of the invention and the following claims.

I claim:

1. In a fuel dispensing nozzle comprising a body having a fuel conduit leading to a spout insertable into a fuel tank, a manually operable fuel valve in said fuel conduit, a vapor conduit for transporting vapor displaced from said tank to a remote vapor handling system, and a vapor shut-off valve in said vapor conduit, the improvement wherein said vapor shut-off valve comprises a first diaphragm having a first surface facing said vapor conduit and a second surface facing a chamber within the nozzle, said first diaphragm causing said vapor conduit to be blocked in a first position of said first diaphragm and not to be blocked in a second position of said first diaphragm, and biasing means urging said first diaphragm to said first position;

said nozzle further including valve opening means for urging said first diaphragm toward said second position only when fuel is flowing past said fuel valve.

2. The improved fuel dispensing nozzle of claim 1 wherein said biasing means comprise a spring disposed in said chamber.

3. The improved fuel dispensing nozzle of claim 1 wherein said valve opening means comprise a conduit extending between said chamber and a portion of said fuel conduit, whereby fuel flow in said fuel conduit produces a reduced pressure in said chamber.

4. The improved fuel dispensing nozzle of claim 3 wherein the conduit comprising said valve opening means communicates with said fuel conduit substantially at the location of said fuel valve.

5. The improved fuel dispensing nozzle of claim 4 wherein said biasing means comprises a spring disposed in said chamber.

6. The improved fuel dispensing nozzle of claim 1 further including a vapor regulator valve in said vapor conduit operable in response to a predetermined vapor pressure condition in said fuel tank, said vapor pressure regulator valve comprising a second diaphragm mounted in said nozzle with a first surface facing said first said diaphragm and a second surface facing said vapor conduit, said second diaphragm blocking said vapor conduit in a first position and not blocking said vapor conduit in a second position, and biasing means urging said second diaphragm to said second position, said nozzle further including a vent linking the region between said diaphragms with the ambient exterior of said nozzle.

7. The improved fuel dispensing nozzle of claim 6 wherein said biasing means for each said diaphragm comprise a spring, the spring biasing said second diaphragm having a lower biasing force than the biasing force of said spring that biases said first diaphragm, thereby enabling said shut-off valve to cause blockage of said vapor conduit in the absence of fuel flow in said fuel conduit but enabling independent operation of said vapor pressure regulator valve in response to pressure conditions in said fuel tank when fuel is flowing in said fuel conduit.

8. The improved fuel dispensing nozzle of claim 7 wherein said spring that biases said first diaphragm has a biasing force which can be overcome by a vacuum level in the range of about two to about three inches of water in said chamber.

9. The improved fuel dispensing nozzle of claim 6 wherein said first and second diaphragms are mounted to be substantially parallel when said first diaphragm is in said first position.

10. The improved fuel dispensing nozzle of claim 9 wherein said first and second diaphragms are spaced apart, said nozzle further including a spacer disc intermediate said first and second diaphragms.

11. The improved fuel dispensing nozzle of claim 10 wherein said spacer disc is formed from a closed-cell foam rubber.

12. In a fuel dispensing nozzle comprising a body having a fuel conduit leading to a spout insertable into a fuel tank having a mouth formed from a magnetically susceptible material, a flexible enclosure spaced apart from and encircling said spout at the end thereof adjacent said nozzle body and terminating in an end plate disposed to engage said fuel tank mouth when said spout is inserted into said tank, said flexible enclosure comprising an attachement portion for securing it to said nozzle, said end plate comprising a magnetic material, thereby enabling positive contact of said end plate with said tank mouth to prevent the escape to the ambient of vapors from said tank, the improvement wherein said shroud comprises a member secured to said attachment portion and to said end plate and having a length along said spout such that said member is taut when said end plate engages said fuel tank mouth.

13. In a fuel dispensing nozzle comprising a body having a fuel conduit leading to a spout insertable into a fuel tank, and a vapor conduit for transporting vapor displaced from said fuel tank to a remote vapor handling system, said vapor conduit defined in part by a flexible enclosure encircling a portion of said spout adjacent said body, the improvement wherein a pressure relief valve is provided in said flexible enclosure for altering the pressure in said vapor conduit when it deviates by more than a predetermind amount from the ambient pressure exterior of said flexible enclosure, said pressure relief valve comprising an opening in a wall of said flexible enclosure, a pair of flexible flaps in face-to-face contact with each other when the pressure within said vapor conduit deviates from said ambient pressure by no more than said predetermined amount, and flap biasing panels urging said flaps together and being sealed around the edges of said opening.

14. The improved fuel dispensing nozzle of claim 13 wherein said wall of said flexible enclosure, said flexible flaps, and said flaps biasing panels are formed integrally from a flexible material.

15. The improved fuel dispensing nozzle of claim 13 wherein said flaps are interior of said vapor conduit, whereby said pressure relief valve is a negative pressure relieve valve enabling the relief of excessive vacuum conditions within said vapor conduit.

16. The improved fuel dispensing nozzle of claim 13 wherein said flaps are exterior of said vapor conduit, whereby said pressure relief valve is a positive pressure relief valve enabling relief of excessive over-pressure conditions within said vapor conduit.

17. The improved fuel dispensing nozzle of claim 16 wherein each of said pressure relief valves is formed integrally with said flexible enclosure.

18. The improved fuel dispensing nozzle of claim 13 wherein said flap biasing panels abut along lines of contact with their respective flexible flaps, the panels together forming an acute angle.

19. The improved fuel dispensing nozzle of claim 18 wherein said acute angle is approximately 30°.

20. A shroud for use with a fuel dispensing apparatus comprising a nozzle for dispensing liquid fuel through a spout connected to a nozzle body and insertable into a fuel tank and a vapor conduit system for conveying vapor from said fuel tank to a vapor handling system, the shroud comprising an attachment portion for securing the shroud to said nozzle, an enclosure portion spaced apart from and encircling said spout adjacent said nozzle body, the region between said enclosure portion and said spout forming a vapor passage, an opening in said shroud for connecting said vapor passage to said vapor conduit system, an end plate secured to said enclosure portion and constructed to form a sealing enagement with the periphery of the mouth of said fuel tank when said spout is inserted into said fuel tank, and a pressure relief valve in said enclosure portion for altering the pressure in said vapor passage when it deviates by more than a predetermined amount from the ambient pressure exterior of said shroud, said pressure relief valve comprising an opening in a wall of said enclosure portion, a pair of flexible flaps in face-to-face contact with each other when the pressure within said vapor conduit diviates from said ambient pressure by no more than said predetermined amount, and flap biasing panels urging said flaps together and being sealed around the edges of said opening.

21. The shroud of claim 20 wherein said attachment portion, said enclosure portion, said flexible flaps, and said flap biasing panels are formed integrally from a flexible material.

22. The shroud of claim 20 wherein said flaps are interior of said vapor conduit, whereby said pressure relief valve is a negative pressure relieve valve enabling the relief of excessive vacuum conditions within said vapor conduit.

23. The shroud of claim 20 wherein said flaps are exterior of said vapor conduit, whereby said pressure relief valve is a positive pressure relief valve for relieving excessing over-pressure conditions within said vapor conduit.

24. The shroud of claim 23 wherein a second pressure relief valve is provided in said flexible enclosure, said second pressure relief valve having the construction of the first pressure relief valve but having the flaps of said second pressure relief valve interior of said vapor conduit, whereby the pair of pressure relief valves permits the relief of both excessive vacuum and excessive over-pressure conditions within said vapor conduit.

25. The shroud of claim 24 wherein each of said pressure relief valves is formed integrally with said enclosure portion from a flexible material.

26. The shroud of claim 20 wherein said flap biasing panels abut along lines of contact with their respective flexible flaps in an acute angle.

27. The shroud of claim 26 wherein said acute angle is approximately 30°.

28. The shroud of claim 20 wherein said end plate includes a permanent magnet for magnetic coupling with the mouth of said fuel tank.

29. The shroud of claim 28 wherein said permanent magnet is encased in an electrically insulating material that is formed integrally with said enclosure portion, said attachment portion, and said pressure relief valve.

30. A valve system for use in a fuel dispensing nozzle a body including a fuel conduit and a fuel valve and a vapor conduit, the valve system comprising a rigid body member abutting said nozzle body and having internal passage means defining a portion of said vapor conduit, body member also defining a peripheral surface around a portion of said passage means, a hollow cap member overlying said body member, a first flexible diaphragm clamped around its periphery between said cap and body members, said hollow cap member defining a chamber adjacent a first surface of said first diaphragm and said vapor means of said body member being adjacent the second surface of said first diaphragm, said first diaphragm movable between a first position in which it causes blockage of said passage means at said peripheral surface and a second position.

biasing means urging said diaphragm toward said first position, and valve opening means for urging said first diaphragm toward said second position only when fuel is flowing past said fuel valve.

31. The valve system of claim 30 wherein said valve opening means comprise a conduit extending between said chamber and a portion of said fuel conduit, whereby fuel flow in said fuel conduit produces a reduced pressure in said chamber.

32. The valve system of claim 31 wherein said biasing means comprise a spring disposed in said chamber.

33. The valve system of claim 32 further including a vapor regulator valve in said vapor passage means operable in response to a predetermined vapor pressure condition in said fuel tank, said vapor pressure regulator valve comprising a second diaphragm mounted between said first diaphragm and said peripheral surface, said second diaphragm engaging said peripheral surface in a first position and being spaced apart therefrom in a second position, and biasing means urging said second diaphragm to said second position, said nozzle further including a vent linking the region between said diaphragms with the ambient exterior of said nozzle.

34. The improved fuel dispensing nozzle of claim 33 wherein said biasing means for said second diaphragm comprise a spring having a lower biasing force than the biasing force of said spring that biases said first diaphragm, thereby enabling said first diaphragm to cause blockage of said passage means in the absence of fuel flow in said fuel conduit but enabling independent operation of said second diaphragm in response to pressure conditions in said fuel tank when fuel is flowing in said fuel conduit.

35. The improved fuel dispensing nozzle of claim 34 wherein said spring that biases said first diaphragm has a biasing force which can be overcome by a vacuum level of about 2 to 3 inches of water in said chamber.

36. The improved fuel dispensing nozzle of claim 33 wherein said first and second diaphragms are spaced apart, said nozzle further including a spacer member intermediate said first and second diaphragms.

* * * * *